US007810564B2

(12) United States Patent
Montgomery et al.

(10) Patent No.: US 7,810,564 B2
(45) Date of Patent: Oct. 12, 2010

(54) MEMORY LOGGING SYSTEM FOR DETERMINING THE CONDITION OF A SLIDING SLEEVE

(75) Inventors: Graeme Montgomery, Benbrook, TX (US); Ricardo Reyes, Benbrook, TX (US); Peter Schoch, Benbrook, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 177 days.

(21) Appl. No.: 12/261,661

(22) Filed: Oct. 30, 2008

(65) Prior Publication Data

US 2010/0109906 A1 May 6, 2010

(51) Int. Cl.
*E21B 47/09* (2006.01)
*E21B 34/10* (2006.01)

(52) U.S. Cl. ..... 166/255.1; 166/66

(58) Field of Classification Search ..... 166/255.1, 166/250.01, 66, 316
See application file for complete search history.

(56) References Cited

U.S. PATENT DOCUMENTS 5,509,474 A * 4/1996 Cooke, Jr. ..... 166/64
5,666,050 A * 9/1997 Bouldin et al. ..... 324/207.26
6,260,616 B1 * 7/2001 Carmody et al. ..... 166/66
7,000,698 B2 * 2/2006 Mayeu et al. ..... 166/255.1

OTHER PUBLICATIONS

U.S. Appl. No. 12/030,036.
U.S. Appl. No. 60/908,616.

* cited by examiner

*Primary Examiner*—Hoang Dang
(74) *Attorney, Agent, or Firm*—Wong, Cabello, Lutsch, Rutherford, & Brucculeri, L.L.P.

(57) ABSTRACT

A memory logging system for determining the status of a sliding sleeve valve disposed within the borehole. The sliding sleeve contains signal inducing devices. A logging tool is conveyed through the sliding sleeve and time intervals between sensor excursions induced by the sleeve's signal inducing devices are recorded and stored within the tool memory. These data are subsequently recovered when the tool is returned to the surface of the earth, and sensor excursion data are processed in a surface processor to ascertain relative axial positions of the sliding sleeve outer housing and the insert. The condition of the sliding sleeve is determined from these relative axial positions.

16 Claims, 4 Drawing Sheets

MEMORY LOGGING SYSTEM FOR DETERMINING THE CONDITION OF A SLIDING SLEEVE

FIELD OF THE INVENTION

This invention is related to borehole logging, and more particularly to a borehole memory logging system for determining the status of a sliding sleeve device disposed within the borehole.

BACKGROUND

Sliding sleeves, are widely used in a variety of hydrocarbon production systems. A sliding sleeve typically includes a tubular outer housing having threaded connections at one or both ends for connection to a tubing string. The insert is axially movable with respect to the outer housing. Embodied as a valve, the outer housing also includes one or more flow ports. Inside the housing, a sleeve mechanism, also known as an insert, is arranged to slide axially within the outer housing. The insert also comprises one or more flow ports. The insert can be positioned to align the flow ports in the sleeve with the flow ports in the housing, which will allow fluid flow through the sliding sleeve valve. Fluid flow can be from the inside or outside of the valve. Alternatively, the insert can be positioned with respect to the sleeve so that the flow ports are not aligned, thereby preventing fluid flow through the sliding sleeve valve.

The basic concept can be embodied to perform other functions, which will not be discussed in detail in this disclosure. For example, in some embodiments, the insert may not have flow ports, but may be arranged to either block the flow ports in the outer housing or not, thereby permitting flow or not. Sliding sleeve devices embodied as valves are disclosed in U.S. Patent Application Ser. No. 60/908,616 filed Mar. 28, 2007 and Ser. No. 12/030,036 filed Feb. 12, 2008, both of which are incorporated herein in their entirety.

In many operation and production applications, it is desired to determine the condition (i.e., whether open or closed) of one or more sliding sleeve in a tubing string within the borehole. Prior art systems include a shifting tool that is passed through the sliding sleeve. The shifting tool engages an open or a closed mechanism, thereby indicating whether the sliding sleeve is open or closed.

Other prior art mechanical tools have been developed that "feel" for a gap behind the insert to determine if the sliding sleeve is open or closed. A problem with these approaches is that the relatively subtle feel of these approaches, which takes the form of mechanical feedback, can in many cases, be difficult to detect and/or properly interpret.

U.S. patent application Ser. No. 12/030,036, previously entered into this application by reference, discloses a sliding sleeve borehole tool having one or more housing magnets affixed to an outer housing and one or more insert magnets affixed to an insert. A casing collar locator (CCL) tool can be conveyed or "logged" through the insert to detect the relative axial positions of the housing magnets and the insert magnets. The relative position of the magnets can then be used to ascertain the position of the insert within the housing, and thus whether the sliding sleeve is in the open or closed condition. In other embodiments of this sliding sleeve tool, other position indicators or signal inducing devices may be used replacing the housing and insert magnets. Examples of such devices include, but are not limited to, radio frequency identification (RFID) devices, radioactive pills, and ferromagnetic components. Relative positions of the signal inducing devices are detected by conveying a logging tool containing one or more sensors responsive to the signal inducing device.

SUMMARY OF THE INVENTION

Disclosed herein is a borehole memory logging system for determining the status of a sliding sleeve valve disposed within the borehole. The sliding sleeve contains signal inducing devices such as magnets, RFID devices, radioactive pills, and ferromagnetic components and the like as disclosed in previously referenced U.S. patent application Ser. No. 12/030,036. The downhole logging tool comprises a tool processor with a tool memory, one or more sensors responsive to the signal inducing devices, a temperature sensor, a clock, and a power supply, such as batteries, to power all electronic components within the tool. The tool is conveyed or logged through the sliding sleeve using coiled tubing, a "slick line", or even a single or multiconductor wireline. Alternately, the tool can be embodied as a "pump down" instrument and conveyed through the sliding sleeve by pressure of flowing drilling fluid.

As the tool is conveyed through the sliding sleeve, time intervals between sensor excursions induced by the sleeve's signal inducing devices are recorded and stored within the tool memory of the tool processor. These data are subsequently recovered when the tool is returned to the surface of the earth, and sensor excursion data are processed in a surface processor to ascertain relative axial position of the sliding sleeve outer housing and the insert. Sliding sleeve condition is then determined from the relative axial position. For a sliding sleeve embodied as a valve, relative housing-insert position of the valve are used to determine the condition of the valve such as open, closed, or partially opened.

The temperature sensor is used as a "backup" indicator of sliding sleeve valve condition. As an example, if the valve is closed, the temperature sensor will record a typically monotonically increase in borehole fluid temperature as a function of depth as it passes through the sliding sleeve valve. If the valve is fully or partially open, formation fluid typically of temperature different from borehole temperature will induce a diversion from the monotonic change in temperature as a function of depth. As with the signal inducing sensor responses, temperature measurements as a function of depth are stored within the tool memory of the tool processor are subsequently recovered and processed at the surface of the earth in the surface processor.

As mentioned above, the sliding sleeve can be embodied with a variety of sleeve signal inducing devices. For purposes of this disclosure, it will be assumed that the signal inducing devices are magnets and the logging tool sensor comprises a coil responsive to these magnets.

BRIEF DESCRIPTION OF THE DRAWINGS

The manner in which the above recited features and advantages, briefly summarized above, are obtained can be understood in detail by reference to the embodiments illustrated in the appended drawings.

DETAILED DESCRIPTION OF THE PREFERRED EMBODIMENTS

Overview

Figure 1:
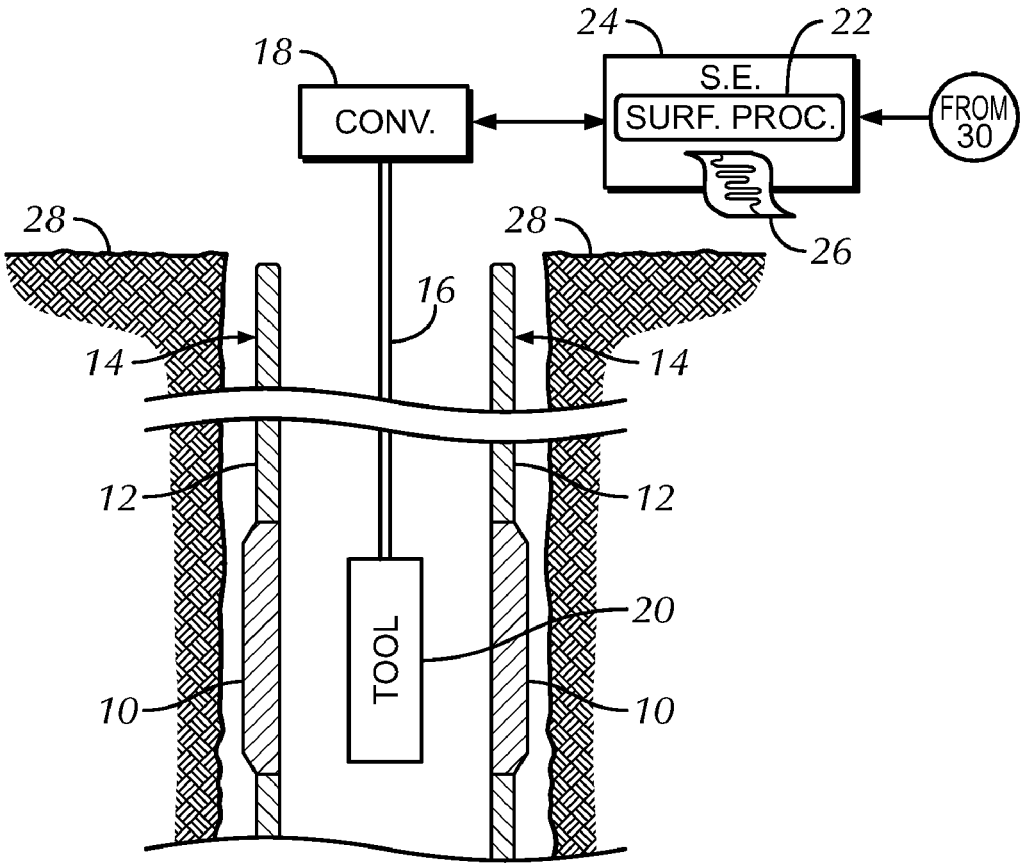
FIG. 1 is a conceptual illustration of major elements of a memory logging system disposed in a borehole environment.

FIG. 1 is a conceptual illustration of major elements of a memory logging system disposed in a borehole environment. The logging tool 20 is suspended within a tubing string 12 in a borehole 14 by a tool conveyor 16 whose lower end is operationally connected to the upper end of the tool. The upper end of the tool conveyor is operationally connected to a conveyance means 18 at the surface of the earth 28. If the memory logging system is a coiled tubing conveyed system, the tool conveyor 16 represents coiled tubing and the conveyance means 18 represents a coiled tubing injector. If the memory logging system is a slick line or wireline conveyed system, the tool conveyor 16 represents a slick line or wireline cable and the conveyance means 18 represents draw works comprising a winch. If the memory logging system is a pump down system, the tool conveyor 16 conceptually represents drilling fluid flowing downward and the conveyance means 18 represents a drilling fluid pump. The conveyance means 18 typically cooperates with surface equipment 24 that, among other functions, tracks the depth of the tool within the well borehole. The surface equipment also comprises a surface processor 22 that receives measured tool data stored in a tool processor 30 (see FIG. 2). Valve condition calculations are made in the surface processor by combining measured and known sliding sleeve parameters using a predetermined algorithm. Results are typically recorded as a function of valve depth and output in the form of a "log" 26.

Still referring to FIG. 1, the tool 20 is shown axially disposed within a sliding sleeve that is an integral element within the drill string. One or more sensors in the tool 20 respond to signal inducing devices within the sleeve. Basic principles of operation of the sliding sleeve and the functions of the signal inducing devices are disclosed in previously referenced U.S. patent application Ser. No. 12/030,036.

Figure 2:
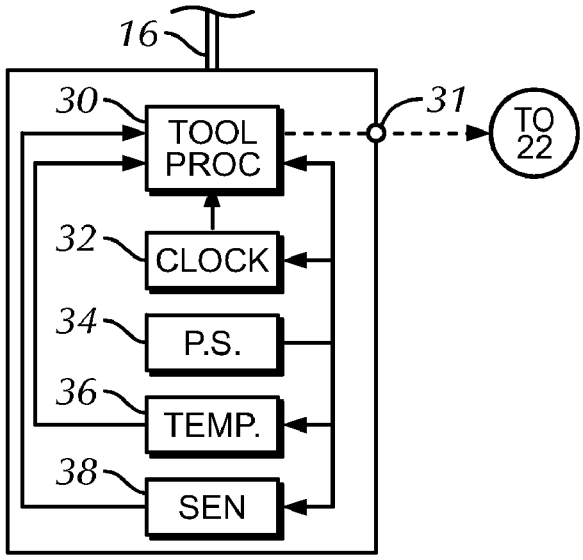
FIG. 2 illustrates the major elements of the logging tool.

FIG. 2 illustrates the major elements of the logging tool 20 in the form of a functional diagram. The tool 20 contains one or more sensors 38 responsive to signal inducing devices within the tool. If the signal inducing devices comprise radioactive sources such as gamma ray sources, the one or more sensors are preferably radially collimated radiation detectors. If the signal inducing devices comprise RFID devices, the one or more sensors comprise radio frequency specific receivers. If the signal inducing devices comprise magnets, the one or more sensors comprise a coil in which a voltage or current diversion or "spike" is induced as the tool and sensor within is conveyed axially past the magnets. For purposes of disclosure, it will be henceforth assumed that the signal inducing devices are magnets and the sensors 38 comprise coils.

Again referring to FIG. 2, the one or more sensors 38 cooperate with a tool processor 30 that contains tool memory (not shown). As the tool 20 is conveyed through the sliding sleeve 100, time intervals between response excursions of the one or more sensors 38 induced by sleeve signal inducing devices are recorded and stored within the tool memory of the tool processor 30. These sensor responses are subsequently retrieved at the surface 28 through a suitable data port 31 and input into a surface processor 22. The tool 20 preferably contains a temperature sensor whose response is used as a backup indicator of the condition of the sliding sleeve 100, as will be detailed in a subsequent section of this disclosure. A clock 32 cooperates with a tool processor 30, as will also be detailed in a subsequent section of this disclosure. A power supply 34, such as a battery pack, supplies power to the tool processor 30, the clock 32, the temperature sensor 36, and the one or more signal inducing devices 38 disposed within the sliding sleeve 100.

Figure 3A:
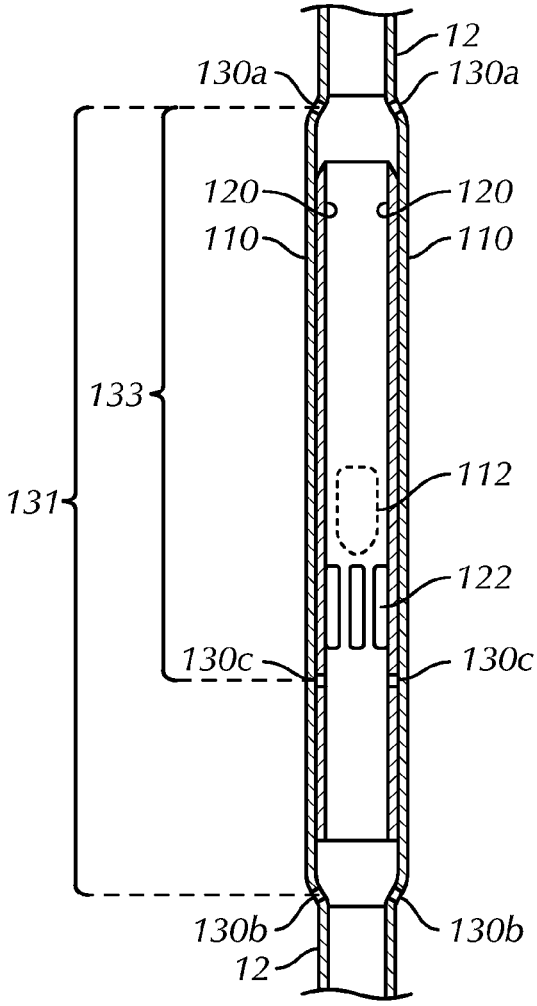
FIG. 3*a* illustrates a sliding sleeve valve in a closed condition.
Figure 3B:
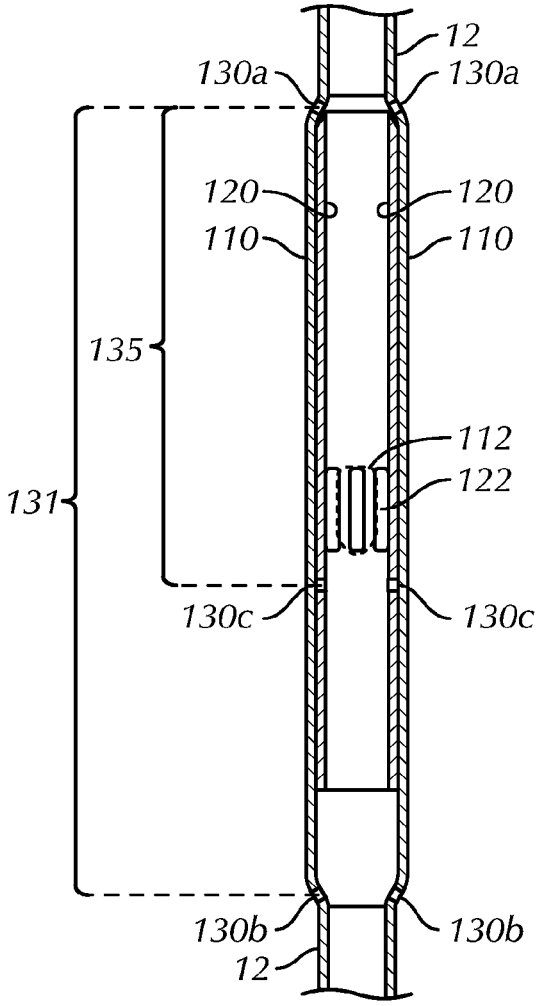
FIG. 3*b* illustrates a sliding sleeve valve in an open condition.

FIGS. 3*a* and 3*b* is an exemplary sliding sleeve apparatus embodied as a valve. The closed condition of sliding sleeve 100 is illustrated in FIG. 3*a*, and the open condition is illustrated in FIG. 3*b*. The sliding sleeve 100 includes an outer housing 110 and a sleeve mechanism or insert 120 disposed therein. The outer housing 110 may be comprised of upper and lower sections and an intermediate section all coupled together. A plurality of flow ports 122 are shown disposed in the housing 110. A single flow port 112 is shown in insert 120. It should be understood that the housing and insert flow ports can be configured using a variety of geometries. Furthermore, flow ports are not needed if the sliding sleeve is embodied as something other than a valve.

As illustrated in FIG. 3*a*, the sliding sleeve valve 100 is closed by moving insert 120 axially downward within housing 110 so that the flow ports 112 and 122 are not axially aligned. Conversely as illustrated in FIG. 3*b*, the sliding sleeve valve 100 is opened by moving insert 120 axially upward within housing 110 to axially align flow ports 112 and 122.

The memory logging system is designed to measure the condition of a sliding sleeve, and more specifically the condition of the exemplary sliding sleeve valve used in this disclosure. Again referring to FIGS. 3*a* and 3*b*, each of the magnets 130*a* and 130*b* preferably comprises a plurality of individual magnets disposed preferably circumferentially in the upper collar and lower collars, respectively, of the sliding sleeve valve outer housing 110. Magnet 130*c* preferably comprises a plurality of individual magnets disposed circumferentially in the insert 120. The dimension 131 represents the known axial spacing between the upper and lower housing magnets 130*a* and 130*b*. Using the upper housing magnets 130*a* as a reference point, the dimensions 133 and 135 are the axial positions of the sleeve magnet 130*c* with the sliding sleeve fully closed and opened, respectfully. Consequentially, by measuring the axial position of the insert magnet with respect to the reference point (e.g. the upper housing magnets 130*a*), the condition of the valve can be determined. Although the insert magnet is always disposed axially between the upper and lower sleeve magnets, it should be understood that numerous magnet arrangements can be used while maintaining the general concepts of this disclosure. Alternate arrangements are discussed in previously referenced U.S. patent application Ser. No. 12/030,036.

Tool Response

Figure 4A:
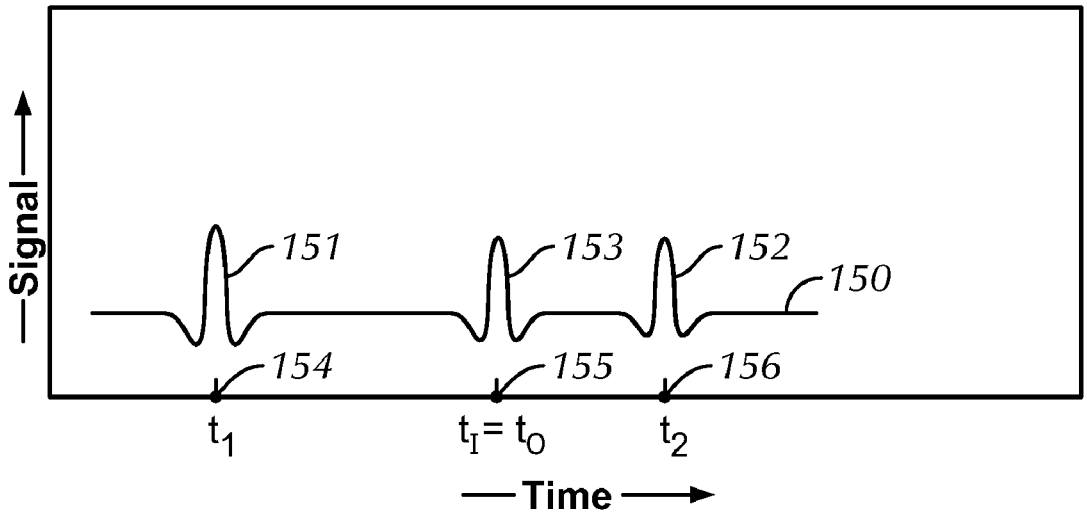
FIG. 4*a* shows conceptually the signal response of a coil sensor as the tool is conveyed through a closed sliding sleeve valve.
Figure 4B:
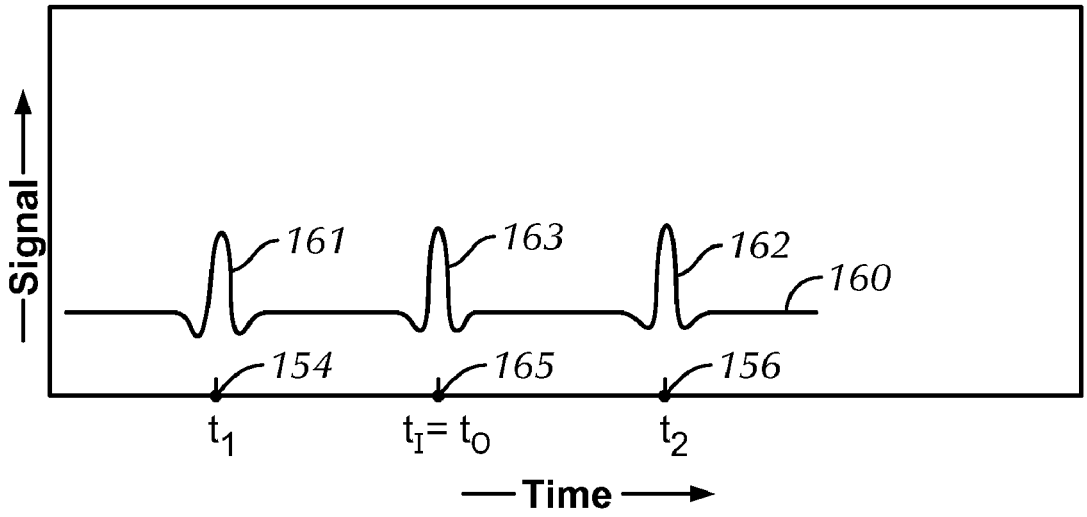
FIG. 4*b* shows conceptually the signal response of a coil sensor as the tool is conveyed through an open sliding sleeve valve.

FIG. 4*a* shows conceptually the signal response 150 of a coil sensor 38 as the tool 20 is conveyed through the closed sliding sleeve valve 100 as shown in FIG. 3*a*. Although illustrated traveling downward through sliding sleeve valve 100, it should be noted that the tool 20 can be conveyed either downward or upward through sliding sleeve valve 100. Signal response (ordinate), which can be voltage or current depending upon the embodiment of the coil sensor assembly, is shown as a function of time (abscissa). Excursion 151 occurs at 154 when the sensor passes the upper sleeve magnet 130*a* at time t1, excursion 153 occurs at time tI=tc at 155 when the sensor passes the sensor magnet with the sleeve is in the fully close position, and excursion 152 occurs at 156 when the sensor passes the lower sleeve magnet at time t2. FIG. 4*b* is similar to FIG. 4*a* but shows conceptually the signal response 160 of the coil sensor 38 as the tool 20 is conveyed through the open sliding sleeve valve 100 as shown in FIG. 3*b*. Excursion 161 again occurs at 154 when the sensor passes the upper sleeve magnet 130*a* at time t1, excursion 163 occurs at time tI=to at 165 when the sensor passes the sensor magnet with the sleeve is in the fully open position, and excursion 162 again occurs at 156 when the sensor passes the lower sleeve magnet at time t2. Times t1, tI and t2 are measured. The time subscript "I" indicates the time of passing the insert magnet with I=O or I=C indicating the valve fully open or closed, respectfully. Dimension 131 is known. Using these measured and known sliding sleeve parameters, the axial position of the insert magnet can be determined relative to a reference point (e.g. the axial position of the upper sleeve magnet). Relative position of the insert magnet can then be used to determine the condition of the valve. Operationally, the magnitude and times of the signal excursions are stored in the tool memory of the tool processor 30. These data are transferred to the surface processor 22 in the surface equipment 24 when the tool is returned to the surface of the earth 28. Details of the calculations will be disclosed in the following section.

Figure 5:
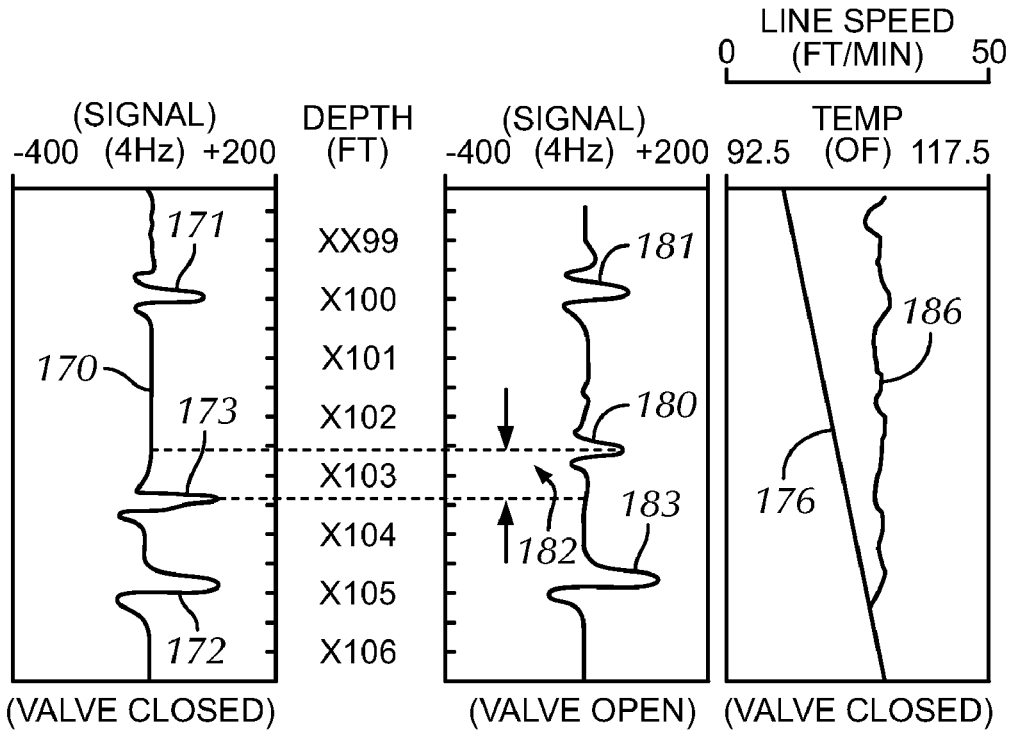
FIG. 5 illustrates actual log traces of a coil sensor response as the logging tool is conveyed through a sliding sleeve valve of the type shown in FIGS. 3*a* and 3*b*.

FIG. 5 illustrates example log traces of a coil sensor response at 4 Hz as the logging tool 20 is conveyed through a sliding sleeve valve of the type shown in FIGS. 3*a* and 3*b*. Tool depth is shown in feet. The left log 170 was obtained with the sliding sleeve valve fully closed. Excursions 171 and 172 represent sensor response as the tool passes upper and lower sleeve magnets 130*a* and 130*b*. Correlating these excursions with the depth scale, it can be seen that the axial spacing of upper and lower sleeve magnets is approximately 5 feet (1.52 meters). Excursion 173 represents the sensor response as the tool passes the insert magnet. The center log 180 was obtained with the sliding sleeve valve fully open. Excursions 181 and 182 again represent sensor response as the tool passes upper and lower sleeve magnets 130*a* and 130*b*. Excursion 183 represents the sensor response as the tool passes the insert magnet. The depth difference between excursions between excursions 173 and 183 is approximately 0.85 feet (25.9 centimeters) and represents the range of the insert between fully open and fully closed. Accuracy of valve condition can be determined with a precision of 0.1 feet (3.0 centimeters).

Still referring to FIG. 5, the trace 176 is the response of the tool's temperature sensor 36. The temperature sensor exhibits a monotonically increase with depth as the tool 20 passes through the sliding sleeve valve 100. This indicates that the sensor is responding only to a monotonic increase in borehole fluid thereby indicating that the valve 100 is fully closed. If the valve 100 were fully or partially open, formation fluid with temperature typically different from that of the borehole fluid would induce a diversion (not shown) from the monotonic change in temperature as a function of depth. As with the signal inducing sensor responses, temperature measurements as a function of depth are stored within the tool memory of the tool processor 30 and are subsequently recovered and processed at the surface of the earth 28 in the surface processor 22. The temperature sensor is used as a qualitative "backup" indicator of sliding sleeve valve condition.

The example logs shown in FIG. 5 were obtained by conveying the logging tool with a slick line. The trace 186 is a measure of line speed, which is approximately 30 feet per minute (9.14 meters per minute). Line speed is measured using a sheave wheel (not shown) cooperating with the surface equipment 24, as is well known in the art. It can be seen that line speed varies with depth. This variation is typically due to varying friction and line stretch as the tool is conveyed. It is noted, therefore, that a measure of line speed in not necessarily a precise measure of tool speed. Sliding sleeve condition accuracy and precision obtainable with the present system is partially a result of accurate and precise tool speed (rather than line speed) measurement, as will be seen in the following section of this disclosure.

Mathematical Formalism

The following formalism is used to illustrate how the condition of a sliding sleeve device is determined from known sliding sleeve parameters and parameters measured by the logging tool 20. It has been mentioned previously that a plurality of signal inducing devices can be used in the sleeve an in the insert. In the most general statement of formalism, the subscript "i" is used to index specific signal inducing devices within the sleeve, and the subscript "j" is used to index specific signal inducing devices within the insert. For the example used in this disclosure, i=1,2 and j=I. Therefore, applying this general convention to the example shown FIGS. 4*a* and 4*b*, $S_1$=the magnitude of the sensor excursion as the sensor passes the upper sleeve magnet;

$S_2$=the magnitude of the sensor excursion as the sensor passes the lower sleeve magnet;

$S_I$=the magnitude of the sensor excursion as the sensor passes the insert magnet;

$t_1$=the time the sensor passes the upper sleeve magnet;

$t_2$=the time the sensor passes the lower sleeve magnet;

$t_I$=the time the sensor passes the insert magnet;

$\Delta t=[t_2-t_1]$; and $\Delta t_I=[t_I-t_1]$

The quantities $\Delta t$ and $\Delta t_I$ are expressed as absolute values so that their algebraic sign will be invariant whether logging is downward or upward in the borehole. The measured parameters $t_1$, $t_2$, $t_{I=O}$, and $t_{I=C}$ are shown graphically in FIGS. 4*a* and 4*b*.

$\Delta x$=the axial spacing between the upper and lower sleeve magnets;

$x_I$=the axial position of the insert magnet;

$x_o$=the axial position of the insert magnet with the valve fully open; and $x_c$=the axial position of the insert magnet with the valve fully closed.

The dimensions $\Delta x$, $x_{I=O}$, and $x_{I=C}$ are shown graphically at 131, 135 and 133, respectively, of FIGS. 3*a* and 3*b*. The dimension $\Delta x$ is known parameter and the dimension $X_I$ is a parameter determined from measured quantities. As defined previously, $x_o$ and $x_c$ are measured with respect to the reference point position of the upper sleeve magnet 130*a*. Tool velocity $v_t$ is therefore $$v_t=\Delta x/\Delta t \tag{1}$$

and $$x_I=v_t\Delta t_I \tag{2}$$

The condition of the valve C is defined as $$C=(x_I-x_c)/(x_o-x_c) \tag{3}$$

where

C=1 indicates that the valve is fully open;

C=0 indicates that the valve is fully closed; and

1>C>0 indicates the degree in which the valve is partially open.

It should be understood that there are other formalisms that can be used to determine the condition of the sliding sleeve valve from measured and known sliding sleeve parameters, and the above is used as a specific illustration.

Figure 6:
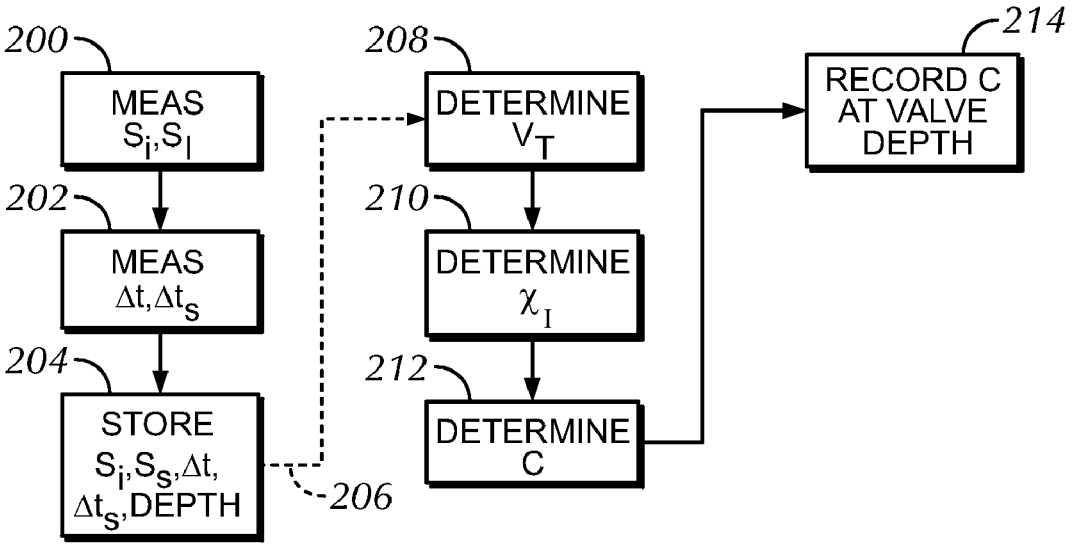
FIG. 6 is a flow chart for an algorithm used to compute the condition of a sliding sleeve using measured and known sliding sleeve parameters.

FIG. 6 is a flow chart for the predetermined algorithm disclosed above, and is programmed in the surface processor 22 to determine the condition of a sliding sleeve device from measured and known sliding sleeve parameters. The sensor responses $S_i$ and $S_I$ are measured at 200, $t_1$, $t_2$ and $t_I$ (or alternately $\Delta t$ and $\Delta t_I$) are determined at 202, and measured and/or determined parameters, including tool depth of the tool 20 at which measurements are made, are stored in tool memory of the tool processor 30 at 204. The tool 20 is then returned to the surface of the earth 28 and measures and/or determined parameters and corresponding depth are transferred to the surface processor 22 of the surface equipment 24, as illustrated conceptually by the broken line 206. Parameters $v_t$, $x_I$, and C are then computed in the surface processor 22 at steps 208, 210 and 212, respectively. Finally, the parameter of interest C, which is the condition of the sliding sleeve, is recorded preferably as a function of the depth of the sliding sleeve device at 214. The process can optionally be repeated for another sliding sleeve device at a different depth in the borehole, with measured and determined parameters preferably being stored in tool memory of the tool processor 30 before the tool 20 is returned to the surface for data extraction.

The above disclosure is to be regarded as illustrative and not restrictive, and the invention is limited only by the claims that follow.

What is claimed is:

1. A memory logging tool comprising:

(a) a tool processor comprising a tool memory;

(b) a sensor; and (c) a clock; wherein said tool is conveyed through a sliding sleeve comprising an outer housing and an insert, said sensor responds to a plurality of signal inducing devices disposed in said outer housing and said insert, said sensor and said clock cooperate with said tool processor to form signals indicative of relative axial positions of said plurality of said signal inducing devices, and said signals are stored within said tool memory.

2. The tool of claim 1 further comprising a data port; wherein:

(a) said signals are extracted from said tool memory and input into a surface processor; and (b) said signals are combined with known sliding sleeve parameters using a predetermined algorithm stored within said surface processor to determine a condition of said sliding sleeve.

3. The tool of claim 1 wherein:

(a) said signal inducing devices are magnets; and (b) said sensor comprises a coil.

4. The tool of claim 1 further comprising a temperature sensor.

5. The tool of claim 2 wherein said tool is conveyed through said sliding sleeve with a slick line or a wireline or a coiled tubing or by pressure exerted by flowing drilling fluid.

6. A memory logging system comprising:

(a) memory logging tool comprising a tool processor comprising a tool memory, a sensor, a clock, and a data port;

(b) a conveyance means;

(c) a tool conveyor operationally connecting said tool and said conveyance means;

(d) surface equipment comprising a surface processor; and (e) a predetermined algorithm programmed in said surface processor; wherein said tool is conveyed through a sliding sleeve comprising an outer housing and an insert, said sensor responds to a plurality of signal inducing devices disposed in said outer housing and said insert, said sensor and said clock cooperate with said tool processor to form signals indicative of relative axial positions of said plurality of said signal inducing devices, said signals are stored within said tool memory, said signals are subsequently extracted from said tool memory through said data port and input into a surface processor; and said signals are combined with known sliding sleeve parameters using a predetermined algorithm stored within said surface processor to determine a condition of said sliding sleeve.

7. The system of claim 6 wherein:

(a) said signal inducing devices are magnets; and (b) said sensor comprises a coil.

8. The system of claim 6 wherein said signals are combined with known sliding sleeve parameters using said predetermined algorithm stored within said surface processor to determine velocity of said tool through said sliding sleeve.

9. The system of claim 6 further comprising a temperature sensor disposed within said tool, wherein:

(a) response of said temperature sensor is stored within said tool memory;

(b) said temperature sensor response is subsequently extracted from said tool memory through said data port and input into said surface processor; and (c) excursions in said temperature sensor as a function of depth are determined in said surface processor to indicate said condition of said sliding sleeve embodied as a valve.

10. The system of claim 6 wherein said tool is conveyed through said sliding sleeve with a slick line or a wireline or a coiled tubing or by pressure exerted by flowing drilling fluid.

11. A method for determining condition of a sliding sleeve disposed within a borehole, the method comprising:

(a) providing a memory logging tool comprising a tool processor comprising a tool memory, a sensor, and a clock;

(b) conveying said tool through a sliding sleeve comprising an outer housing and an insert;

(c) measuring sensor responses to a plurality of signal inducing devices disposed in said outer housing and said insert;

(d) with said sensor and said clock cooperate with said tool processor, forming signals indicative of relative axial positions of said plurality of said signal inducing devices; and (e) storing said signals within said tool memory.

12. The method of claim 11 further comprising the steps of:

(a) returning said tool to the surface;

(b) extracting said signals from said tool memory through a data port and inputting said signals into a surface processor; and (c) combining said signals with known sliding sleeve parameters using a predetermined algorithm stored within said surface processor to determine a condition of said sliding sleeve.

13. The method of claim 12 further comprising the step of combining said signals with known sliding sleeve parameters using said predetermined algorithm stored within said surface processor to determine velocity of said tool through said sliding sleeve.

14. The method of claim 11 wherein:

(a) said signal inducing devices are magnets; and (b) said sensor comprises a coil.

15. The method of claim 11 further comprising the steps of (a) disposing a temperature sensor within said tool;

(b) storing response of said temperature sensor within said tool memory;

(c) subsequently extracting said temperature sensor response from said tool memory through said data port and inputting said temperature response into said surface processor;

(d) in said surface processor, determining from excursions in said temperature sensor as a function of depth said condition of said sliding sleeve embodied as a valve.

16. The method of claim 12 further comprising conveying said tool through said sliding sleeve with a slick line or a wireline or a coiled tubing or by pressure exerted by flowing drilling fluid.

* * * * *